US005282619A

United States Patent [19]

Napolitano et al.

[11] Patent Number: 5,282,619

[45] Date of Patent: Feb. 1, 1994

[54] PRACTICE GOLF CLUB HAVING A COLLAPSIBLE AND ADJUSTABLE LENGTH SHAFT

[76] Inventors: Anthony P. Napolitano, 83 W. Windsor Pkwy., Oceanside, N.Y. 11572; Carl E. Troiano, 107 Shore Rd., Lindenhurst, N.Y. 11757

[21] Appl. No.: 977,149

[22] Filed: Nov. 16, 1992

[51] Int. Cl.[5] ..... A63B 69/36; A63B 53/16

[52] U.S. Cl. ..... 273/80 D; 273/81.2; 273/193 R

[58] Field of Search ..... 273/80 R, 80 B, 80 D, 273/193 R, 194 R, 77 R, 81.2, 162 R

[56] References Cited

U.S. PATENT DOCUMENTS

| | | | |
|---|---|---|---|
| 1,613,360 | 1/1927 | Rigby | 273/80 D |
| 1,943,066 | 1/1934 | Ford | 273/80 D |
| 3,102,726 | 9/1963 | Barrett | 273/80 D |
| 3,524,646 | 8/1970 | Wheeler | 273/80 D |
| 3,614,101 | 10/1971 | Hunter | 273/80 B X |
| 3,663,019 | 5/1972 | Palotsee | 273/80 D X |
| 4,932,661 | 6/1990 | Choi | 273/80 D X |

*Primary Examiner*—Mark S. Graham
*Assistant Examiner*—Sebastiano Passaniti
*Attorney, Agent, or Firm*—Galgano & Belkin

[57] ABSTRACT

A practice golf club has a collapsible adjustable shaft. The golf club includes a club head, a handle, and a shaft. The shaft has a number of telescopic sections that permit the shaft to be adjustable between a fully extended position and a fully collapsed position. The club head is attached to the lowermost shaft section and the handle is attached to the uppermost shaft section. A locking nut and a compression ring permit adjacent sections of the telescopic section to be releasably locked in a fixed position relative to each other at any location between a fully extended position and a fully collapsed position.

3 Claims, 1 Drawing Sheet

10
11
12
13
20
21
22
23
24
25
26
27
28
30
31
32
40
41
42
43
44

PRACTICE GOLF CLUB HAVING A COLLAPSIBLE AND ADJUSTABLE LENGTH SHAFT

BACKGROUND OF THE INVENTION

The present invention relates generally to golf clubs. More particularly, this invention relates to a practice golf club having a collapsible and adjustable length shaft.

A majority of the golf clubs fabricated today are designed for use on golf courses and are made with a fixed length shaft. Numerous attempts have been made to create a collapsible length shaft for golf clubs. Examples of collapsible shafts are U.S. Pat. Nos. 4,674,747, and 3,528,660 by Kategian which disclose a golf club having a shaft composed of a plurality of locking tubular sections which provide a friction lock when the tubular shaft is in a fully extended position. Similarly, U.S. Pat. No. 3,829,092 by Arkin discloses a golf club with a collapsible shaft which employs a locking pin at each adjacent tubular section for securing the shaft in a fully extended position. Another example, U.S. Pat. No. 3,516,697 by Hahn describes a golf club in which the shaft contains connectors permitting the shaft to be completely disconnected. Lastly, U.S. Pat. No. 3,663,019 by Palotsee discloses a golf putter having a telescoping lower shaft section and a pivoting upper shaft section.

Additionally, numerous attempts have been made to create adjustable length shaft for golf clubs. Examples such as U.S. Pat. No. 5,083,779 by Ungermann, U.S. Pat. No. 5,029,860 by Ehrich, U.S. Pat. No. 3,539,185 by Andia, U.S. Pat. No. 3,524,646 by Wheeler, U.S. Pat. No. 3,214,170 by Warnock, U.S. Pat. No. 2,214,079 by Horton, and U.S. Pat. No. 2,107,983 by Hamilton describe golf clubs which are adjustable in length whereby the shaft is permitted to slide into the handle for minor adjustments in the overall length. Similarly, U.S. Pat. No. 3,102,726 by Barret, discloses a golf club which provides means for minor adjustments of the length of the club by sliding the shaft into a stem bore located either at the lower club end or the upper handle end of the shaft.

Other telescoping connectors and articles are disclosed in U.S. Pat. Nos. 5,083,779; 5,029,860; 4,858,633; 4,653,142; 4,674,747; 4,596,405; 4,582,079; 4,528,998; 3,9S7,807; 3,840,231; 3,834,722; 3,829,908; 3,829,092; 3,811,455; 3,722,903; 3,663,019; 3,539,185; 3,528,660; 3,524,646; 3,516,697; 3,214,170; 3,206,205; 3,153,252; 3,102,726; 3,070,370; 2,717,609; 2,214,079; 2,107,983; 1,953,387; 1,632,639; 1,205,809; 942,490; 825,006; 478,460; 401,061; and D-313,671.

However, so far as is known, no presently available practice golf club has a fully adjustable, telescopic shaft which can be conveniently and easily locked in position between a fully extended and fully collapsed position in a highly effective and yet simple manner as presently proposed.

SUMMARY OF THE INVENTION

Accordingly, it is an object of the present invention to provide an improved practice golf club having a shaft that is both telescopically collapsible and adjustable for use at any position between a fully extended position and a fully collapsed position.

It is also an object of the present invention to provide such a golf club that is collapsible and suitable for travel in a suitcase.

It is a further object of the present invention to provide such a golf club that is lightweight, easy to use and that allows one to practice one's golf swing in a wide range of environments.

It is another object of the present invention to provide such a golf club which permits adjustment of the length of the shaft by an individual golfer based on his height or other characteristics.

It is still another object of the present invention to provide such a golf club having interchangeable club heads such as irons, woods and putters.

Certain of the foregoing and related objects are readily obtained in a practice golf club having a club head such as an iron, wood or putter at one end, a handle or grip at the other end, and a collapsible and adjustable shaft interconnected therebetween. The shaft has a number of telescopic sections that permit the shaft to be adjustable between a fully extended position and a fully collapsed position. The club head is attached to the lowermost shaft section and the handle is attached to the uppermost shaft section. Locking means, preferably a locking nut and a compression ring, permit adjacent inner and outer section of the telescopic section to be releasably and threadably locked in a fixed position relative to each other at any location between a fully extended position and a fully collapsed position.

In a preferred embodiment of the invention, the uppermost section has a lower externally threaded end and the compression ring and locking nut are slidably received on the lowermost section. The locking nut has an internally threaded bore threadably receivable on the externally threaded end with the compression ring sandwiched therebetween to effect locking of the sections together. Most desirably, the locking nut has a lower end with a radially inwardly directed shoulder and the ring is disposed between the shoulder and the end of the uppermost section so that, when the locking nut is tightened on the uppermost section, the ring is compressed and prohibits relative movement between the lowermost and the uppermost sections.

Most advantageously, the shaft includes three telescopic sections which are fabricated from aluminum and are tubular in shape.

In a particular preferred embodiment of the invention, the lower end of the uppermost section and the locking nut shoulder are chamfered and the ends of the compression ring are chamfered for engagement with the chamfered shoulder of the locking nut and lower end of the uppermost section. Most advantageously, the locking nut has an outer knurled gripping surface so that a golfer can obtain a secure grip thereon.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

In the drawings, wherein similar reference characters denote similar elements throughout the several views.

DETAILED DESCRIPTION OF THE PREFERRED EMBODIMENT

Figures 1, 2, 3, 4:
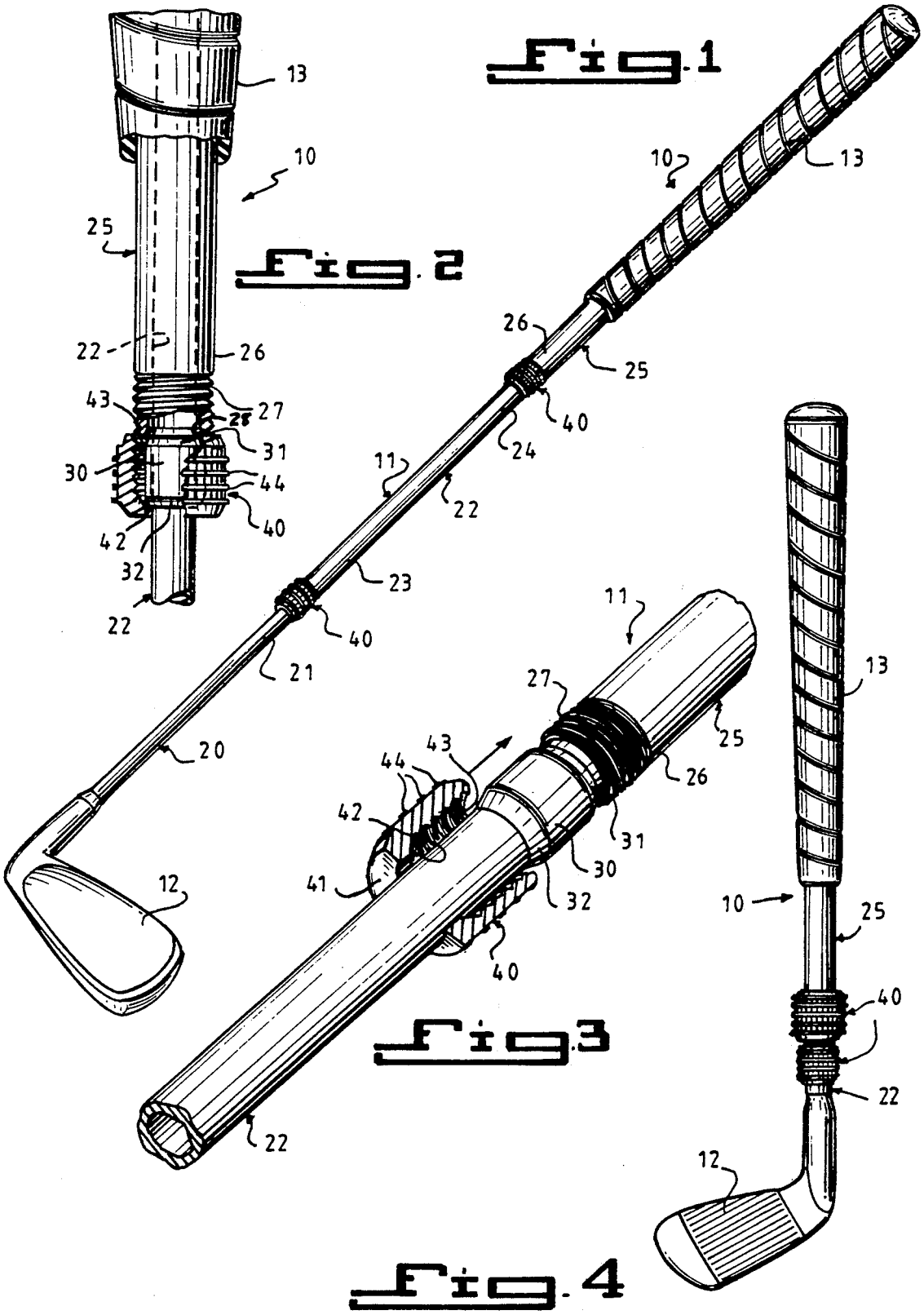
FIG. 1 is a perspective view of the practice golf club embodying the present invention in a fully extended position.
FIG. 2 is a fragmentarily-illustrated side elevational view, in part section, of the locking means for releasably locking the upper section and the center section of the shaft in a fixed position relative to each other.
FIG. 3 is an enlarged, fragmentarily-illustrated perspective view of the locking means shown in FIG. 2, showing the locking nut and compression ring prior to locking.
FIG. 4 is an elevational view of the practice golf club in a fully collapsed position.

Turning now in detail to the drawing, and in particular to FIG. 1, therein illustrated is a practice golf club 10 embodying the present invention, having a shaft 11, a club head 12 attached to the lower portion of the shaft and a handle 13 attached to the upper portion of the shaft. The club head shown in FIG. 1 is an iron which can be interchanged with a variety of different size irons, drivers, or putters by, e.g., screw type attachment or the like. Alternatively, the club head 12 could be permanently attached to the lower end of shaft 11.

Shaft 11 is adjustable between a fully extended position (FIG. 1) and a fully collapsible position (FIG. 4). The fully collapsible position is ideally suitable for packaging for sale, transporting in a suitcase, carrying to a practice area and otherwise storing the same when the golf club is not in use. Preferably the shaft is fabricated from aluminum or graphite/epoxy composite material permitting the shaft to be lightweight and at the same time rigid. For practicing one's golf swing, the shaft 11 is adjustable to a proper length by a golfer based his height or other characteristics, and subsequently locked into position. The practice golf club is also well suited to a small child or a teenager for learning the fundamentals and techniques of a proper golf swing.

Referring again to FIG. 1, shaft 11 includes a multiplicity of telescopic sections. Specifically, as shown in FIG. 1, the shaft 11 includes three (3) telescopic sections, a lower section 20, a center section 22, and an upper section 25, successively telescopic and received within one another, which permits the golf club to collapse to a size approximately one third its fully extended length. More specifically, the upper end 21 of the lower section 20 is inserted into the lower end 23 of the center section 22, and the upper end 24 of the center section 22 is inserted into the lower end 26 of the upper section 25. The overall length of the shaft is decreased by fully inserting the lower section 20 further into the center section 22 and fully inserting the center section 22 into the upper section 25. The adjacent ends of each section of shaft 11 (i.e., ends 21, 23; and ends 24, 26) have complementary stops and flanges (not shown) prohibiting one section from fully disengaging from an adjacent section in the fully extended position.

Referring to FIG. 3, the locking means for releasably locking the upper section 25 in a fixed relation to the center section 22 includes a resilient compression ring 30 and a locking nut 40. Locking nut 40 includes a lower shoulder 41 having an aperture which is axially aligned with shaft center section 22 and which closely fits the outer surface of shaft center section 22. The lower shoulder 41 of the locking nut 40 surrounding the aperture has a inner chamfer or seat 42 for acceptance of the complementary chamfered ring 30. Threads 43 on the inner surface of the upper end of the locking nut 40 correspond to external threads 27 on the lower end 26 of the upper section 25. The locking nut preferably has an outer knurled surface 44 so that a golfer can obtain a tight grip thereon.

The compression ring 30 substantially surrounds the center section 22 and is slideably positioned between the locking nut 40 and the upper section 25. The ring 30 has a chamfered surface 31, 32 on each end for engaging with the upper section 25 and locking nut 40. Specifically, the chamfered surface 31 on the upper end of the ring 30 engages with the seat 28 on the lower end 26 of the upper section 25. The chamfered surface 32 on the lower end of the ring 30 engages with the seat 42 in the locking nut 40.

To releasably lock the upper section 25 in a fixed relation to the center section 22, the locking nut 40 is threaded and tightened onto the threads 27 of lower end 26 of the upper section 25. The chamfered surfaces 31, 32 of the ring 30 fit closely and engage with the seat 28 of the upper section 25 and the seat 42 of the locking nut 40, as shown in FIG. 2. The tightening of the locking nut causes a wedging action at both ends of the ring so that the ring will be contracted tightly against the surface of the center section 22 and the chamfered seat 28 of the upper section 25 to hold the telescopic sections in a locked and fixed relation to one another. Similarly, when the locking nut 40 is loosened the pressure on the compression ring 30 will be released so that the telescopic sections may be moved and repositioned. Preferably, the insert is made of plastic, rubber or a synthetic rubber which is resilient to the repetitive compressive forces of the locking nut and which has a high coefficient of fiction for frictionally locking the adjacent telescopic sections together.

Locking means for releasably locking the center section 22 to the lower section 20 is similar to the locking means employed between the upper section 25 and the center section 22, and includes a corresponding locking nut 40 and a compression ring.

The golf club as described above is designed for practicing one's golf swing without a ball (e.g., in one's hotel room) and/or for hitting no more than a light plastic golf ball, such as a whiffle ball. An alternative embodiment for hitting regulation size golf balls could make use of a shaft fabricated from steel.

Thus, while only one embodiment of the present invention have been shown and described, it is obvious that many changes and modification may be made thereunto without departing from the spirit and scope of the invention.

What is claimed is:

1. A practice golf club for practicing one's golf swing of golf woods and irons comprising:

a shaft having three telescopic, cylindrical shaft sections, adjustable in an axial direction between a fully extended and a fully collapsed position, said sections including an uppermost section, a middle section and a lowermost section, the latter of which is telescopically received in said middle section and said middle section being telescopically received in said uppermost section, said uppermost section and said middle section each having a lower, externally threaded and chamfered end;

a handle attached to the uppermost section;

a club head attached to the lowermost section; and locking nut means for threadably releasably and adjustably locking said adjacent sections of said shaft in a position between and including said fully extended and collapsed positions, said locking nut means including a compression ring and locking nut slidably received on each of said middle and lowermost sections, and said locking nuts each having an internally threaded bore threadably receivable on said externally threaded end of said uppermost and middle sections with said compression ring sandwiched therebetween to effect locking of said sections together, said locking nuts each having a lower end with a radially inwardly directed shoulder and said rings being disposed between said shoulder and said ends of said middle and uppermost sections, respectively, so that when the locking nut is tightened on said uppermost and middle sections the rings are compressed and prohibit relative movement between said lowermost, middle and said uppermost sections, said locking nut shoulders being chamfered and said ends of said compression rings being chamfered for engagement with said chamfered shoulder of said locking nut and lower end of said middle and uppermost sections, respectively, wherein said sections remain in a fixed, locked position with respect to one another during a practice golf swing.

2. The practice golf club according to claim 1, wherein said shaft includes three telescopic sections.

3. The practice golf club according to claim 1, wherein said locking nut has an outer knurled gripping surface.

* * * * *